United States Patent [19]

Garza

[11] 3,971,109

[45] July 27, 1976

[54] WEAVING FRAME SUPPORTING DEVICE

[75] Inventor: Jose G. Garza, San Ysidro, Calif.

[73] Assignee: The Raymond Lee Organization, Inc., New York, N.Y. ; a part interest

[22] Filed: Feb. 10, 1975

[21] Appl. No.: 548,336

[52] U.S. Cl. ..... 28/15
[51] Int. Cl.[2] ..... D03D 29/00
[58] Field of Search ..... 28/15; 211/45, 175; 66/3, 4; 139/34

[56] References Cited

UNITED STATES PATENTS

| | | | |
|---|---|---|---|
| 1,518,304 | 12/1924 | Cahn | 211/45 |
| 2,273,446 | 2/1942 | Meyer | 28/15 |
| 2,885,090 | 5/1959 | Forman et al. | 211/175 |

*Primary Examiner*—Louis K. Rimrodt
*Attorney, Agent, or Firm*—Daniel Jay Tick

[57] ABSTRACT

A weaving frame supporting device comprises a support member of adjustable variable length supported vertically by a base member. A bifurcated head member is adjustably affixed to the free end of the support member and has a pair of spaced parallel arms. A clamp member is rotatably adjustably affixed to and between the arms of the head member and has clamps thereon for releasably clamping a weaving frame thereto in a manner whereby the clamping member is adjustable angularly to position the clamps at selected angles relative to horizontal.

2 Claims, 7 Drawing Figures

WEAVING FRAME SUPPORTING DEVICE

DESCRIPTION OF THE INVENTION

The present invention relates to a weaving frame supporting device. More particularly, the invention relates to a weaving frame supporting device for supporting a weaving frame in a desired position.

Objects of the invention are to provide a weaving frame supporting device of simple structure, which is inexpensive in manufacture, used with facility and convenience, and functions efficiently, effectively and reliably to support a weaving frame in any desired position.

In order that the invention may be readily carried into effect, it will now be described with reference to the accompanying drawing, wherein.

In the FIGS., the same components are identified by the same reference numerals.

Figures 1, 2, 3, 4, 5, 6, 7:
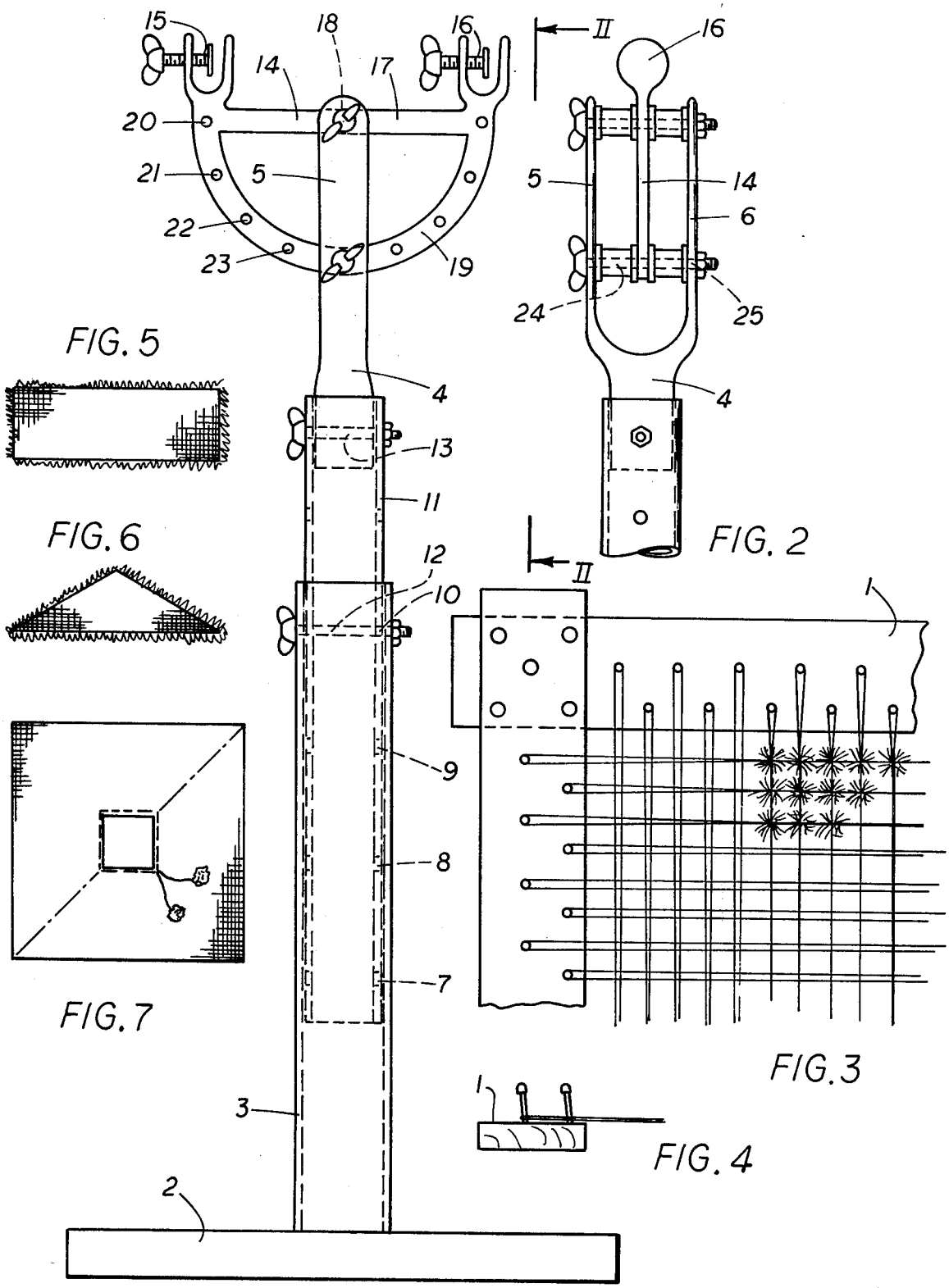
FIG. 1 is a view of an embodiment of the weaving frame supporting device of the invention.
FIG. 2 is a view, taken along the lines II-II, of FIG. 1.
FIG. 3 is a view of a weaving frame of the type supported by the weaving frame supporting device of the invention.
FIG. 4 is an end view of part of the frame of FIG. 3.
FIGS. 5, 6 and 7 are views of garments woven on the weaving frame of FIG. 3.

The present invention relates to the weaving frame supporting device for supporting a weaving frame 1 (FIG. 3) in a desired position.

As shown in FIG. 1, the weaving frame supporting device 1 of the invention comprises a base member 2. A support member 3 of adjustable variable length is supported substantially vertically by the base member 2. The support member 3 has an axis.

A bifurcated head member 4 (FIGS. 1 and 2) is adjustably affixed to the free end of the support member 3 and has a pair of spaced substantially parallel arms 5 and 6 (FIG. 2).

The support member 3 and the head member 4 comprise a plurality of telescoped sections having substantially diametrical spaced bores such as, for example, bores 7, 8, 9, 10, and so on, of a section 11 thereof, formed therethrough. Pin type or bolt devices 12 and 13 extend through selected bores of selected sections of the support member thereby determining the length of the support member.

A clamp member 14 (FIGS. 1 and 2) is rotatably adjustably affixed to and between the arms 5 and 6 of the head member 4 and has clamps 15 and 16 (FIG. 2) thereon for releasably clamping a weaving frame of the type of FIG. 3 thereto in a manner whereby the clamping member is adjustable angularly in a plane through the axis of the support member to position the clamps at desired angles relative to horizontal.

The clamp member 14 comprises a substantially linear member 17 rotatably affixed at its center 18 between the arms 5 and 6 of the head member 4 (FIG. 1) at upper points between said arms. A substantially semicircular member 19 is affixed to the linear member 17 to form a substantially D-shape and has a plurality of spaced holes 20, 21, 22, 23, and so on, formed therethrough (FIG. 1). The member 19 is affixed at a selected one of the holes 20 to 23, and so on, to lower points 24 and 25 between the arms 5 and 6.

While the invention has been described by means of a specific example and in a specific embodiment, I do not wish to be limited thereto, for obvious modifications will occur to those skilled in the art without departing from the spirit and scope of the invention.

I claim:

1. A weaving frame supporting device for supporting a weaving frame in a desired position, said weaving frame supporting device comprising a base member;

a support member of adjustable variable length supported substantially vertically by the base member, said support member having an axis;

a bifurcated head member adjustably affixed to the free end of the support member and having a pair of spaced substantially parallel arms; and a clamp member rotatably adjustably affixed to and between the arms of the head member and having clamping means thereon for releasably clamping a weaving frame thereto in a manner whereby the clamping member is adjustable angularly in a plane through the axis of the support member to position the clamping means at selected angles relative to horizontal, said clamp member comprising a substantially linear member rotatably affixed at its center between the arms of the head member at upper points between said arms and a substantially semicircular member affixed to the linear member to form a substantially D shape having a plurality of spaced holes formed therethrough and affixed at a selected one of the holes to lower points between said arms.

2. A weaving frame supporting device as claimed in claim 1, wherein the support member and head member comprise a plurality of telescoped sections having substantially diametrical spaced bores formed therethrough and pin means extending through selected bores of selected sections whereby the length of the support member is determined.

* * * * *